US006473024B2

(12) United States Patent
Toyoda et al.

(10) Patent No.: US 6,473,024 B2
(45) Date of Patent: Oct. 29, 2002

(54) ELECTROMAGNETIC WAVE ABSORBER

(75) Inventors: Junichi Toyoda, Tokyo; Katsumi Okayama; Sakan Iwashita, both of Kanagawa, all of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/778,706

(22) Filed: Feb. 7, 2001

(65) Prior Publication Data

US 2001/0038353 A1 Nov. 8, 2001

(30) Foreign Application Priority Data

Feb. 8, 2000 (JP) ..... 2000-030529

(51) Int. Cl.[7] ..... H01Q 17/00
(52) U.S. Cl. ..... 342/1; 342/4

(58) Field of Search ..... 342/1, 2, 3, 4; 428/411.1

(56) References Cited

U.S. PATENT DOCUMENTS 3,568,195 A * 3/1971 Wesch et al. ..... 342/1
4,003,840 A * 1/1977 Ishino et al. ..... 342/1 X
5,543,796 A * 8/1996 Thomas et al. ..... 342/4

* cited by examiner

*Primary Examiner*—Bernarr E. Gregory
(74) *Attorney, Agent, or Firm*—Sonnenschein, Nath & Rosenthal

(57) ABSTRACT

An electromagnetic wave absorber including a mixture comprising a magnetic material particle and a binding material. The magnetic material includes a nucleus of an organic material and a magnetic material film is formed on a surface of the nucleus.

13 Claims, 3 Drawing Sheets

ELECTROMAGNETIC WAVE ABSORBER

RELATED APPLICATION DATA

The present application claims priority to Japanese Application No. P2000-030529 filed Feb. 8, 2000, which application is incorporated herein by reference to the extent permitted by law.

BACKGROUND OF THE INVENTION

1. Field of the Invention

The present invention relates to an electromagnetic wave absorber. More particularly, the invention relates to an electromagnetic wave absorber made of a mixture of a magnetic material and a binding material.

2. Description of the Related Art

As electronic instruments have become smaller and the frequencies have increased there has arisen a serious electromagnetic environmental problem. A noise radiated or leaked from electronic component on a printed board, a communication device or the like has a negative influence on other instruments, or an erroneous operation is caused by an electromagnetic wave from the outside. One countermeasure against this, is to change the wiring pattern of a printed board or to use different components. However, this approach has several disadvantages in that the design must be reconsidered, the costs of the parts are high, and the time required to make a product becomes long. On the other hand, an electromagnetic wave absorber that absorbs unnecessary electromagnetic waves causes the noise itself to be reduced. Therefore, the use of an electromagnetic wave absorber has become the main means for attaining a stable function of an electronic instrument or a communication instrument.

However, in recent years, equipment has been increasingly miniaturized, the packaging density of various semiconductor elements mounted on a substrate has been remarkably increased, and space for the arrangement of the electromagnetic wave absorber is decreased even though the electromagnetic environment becomes worse. In order to solve this, it is necessary to raise the electromagnetic wave absorbing power of the electromagnetic wave absorber.

A conventional electromagnetic wave absorber, is formed by producing particles of a spinel-type ferrite sintered body, a hexagonal ferrite sintered body, or a flake-shaped soft metal magnetic material mixed with a resin. Material parameters that affect the characteristics of an electromagnetic wave absorber are the complex dielectric constant $\epsilon$ and the complex permeability $\mu$ at a high frequency. In an electromagnetic wave absorber using a magnetic material, $\mu''$ (imaginary part of the permeability, term of magnetic loss) of the complex permeability $\mu$ ($=\mu''-j\ \mu''$) concerns the electric wave absorption characteristics.

Although a magnetic material capable of coping with a high frequency is generally used for the electromagnetic wave absorber, it is necessary to raise $\mu''$ as a physical constant for converting electromagnetic wave energy into heat at the frequency. Normally, a material of about 5 to 10 in the GHz band is used. As the electromagnetic wave absorber used for an electromagnetic wave absorbing sheet for an EMC (Electromagnetic Compatibility) countermeasure or for an electromagnetic interference suppressor sheet, a composite magnetic material in which spinel-type ferrite powder or flat soft magnetic material metal powder is mixed with resin is known in the art.

The shape of the magnetic material powder may be a flake shape, a flat shape, a resin shape or a fiber shape. When the powder is made as a disk shape or an elliptical shape and the surface is made smooth, although anisotropy in an in-plane direction is decreased and anisotropy in a plane vertical direction is increased, so that the permeability is increased. As a result, a high permeability up to a high frequency exceeding to Snoek limit (limit of rotating magnetization) can be obtained. As a method of forming such a disk-shaped magnetic material, a method of forming it from a thin film, a method of forming it from a spherical particle, and a method of smoothing its surface have been previously used.

FIG. 5 is a schematic explanatory view showing a method of forming a disk-shaped magnetic material from a thin film.

As shown in the drawing, a disk-shaped magnetic material is obtained by forming a thin film on a base film 1 through a mask 2 by sputtering, evaporation, CVD or the like. The drawing shows an evaporation method by an Ar beam 4, and a target 3 uses a material such as a Fe base magnetic material.

The molten metal is evaporated from the target 3 of the Fe base magnetic material through the mask 2 in which a pattern of a number of holes (not shown) are formed and is adhered to the base film 1. Subsequently, the mask 2 is removed and disk-shaped fine particles 5 of disk-shaped metal magnetic materials are adhered to the base film 1. The disk-shaped fine particles 5 are then peeled off from the base film 1 to form the disk-shaped metal magnetic materials.

FIG. 6 is a schematic explanatory view showing a method of forming a disk-shaped magnetic material from a spherical powder particle. First, spherical particles 7 are formed by an atomizing method or a chemical deposition method. In the chemical deposition method, metal salt of iron is reduced to deposit iron fine particles. In the atomizing method, molten metal is dropped or is blown by a nozzle into a high speed fluid of gas, water or the like, and fin particles are formed by the fluid during a cooling process. The diameters of the spherical particles 7 may be adjusted from several hundreds nm to several tens $\mu$m in accordance with design conditions of electromagnetic wave absorber. Such spherical particles 7 are then crushed by applying the physical force of a stamp mill 4 to form flat disk-shaped fine particles 5.

FIG. 7 is a schematic view showing a method of processing the powder magnetic materials, which are formed in FIGS. 5 and 6, by acid. A flake-shaped magnetic material particle 6 that has a surface which includes irregularities or protrusions is immersed in an acid solution so that the surface becomes smooth resulting in a circular flat plate magnetic material 9 having high permeability.

However, in the case where the soft metal magnetic material is formed from the thin film as in FIG. 5, practical application is difficult in view of costs. In the case where the magnetic material is formed from the spherical powder particle as in FIG. 6, it is difficult, because of microscopic irregularities, protrusions or the like, to form a flat metal soft magnetic material having a skin depth or less in which an electromagnetic wave can penetrate. Furthermore, both of the above methods are not optimum forming methods in view of reproducibility or mass productivity. Also, in the method of processing the flake-shaped powder by acid, the yield of complete circular powder is low, and there is a problem in maintaining a uniformity of shape.

SUMMARY OF THE INVENTION

The present invention has been made in view of the above related art, and has an object to provide an electromagnetic wave absorber which is improved in uniformity, reproducibility, and productivity by forming a soft metal magnetic material flat plate, which has a smoothed surface, of a regular shape, such as a disk or ellipse easily, stably and at low cost.

In order to achieve the above object, the present invention provides an electromagnetic wave absorber which is made of a mixture of a magnetic material particle and a binding material and is characterized in that the magnetic material particle comprises a nucleus made of an organic material and a magnetic material film formed on its surface.

According to this structure, by forming the magnetic material particle by the nucleus made of the organic material and the magnetic material film formed on the surface, the nucleus of a regular shape disk shape or elliptical flat plate shape can be formed by a synthetic resin material or the like easily and at low cost, and by coating the surface of this nucleus with the magnetic material film, the surface of the magnetic material particle is smoothed and comes to have the regular shape disk or elliptical shape. By this, the permeability as the electromagnetic wave absorber is increased, and the uniformity, reproducibility, and productivity are raised.

A preferred structural example is characterized in that a thickness of the magnetic material film is a thickness of a skin depth or less.

According to this structure, an electromagnetic wave is certainly permeated into the magnetic material film and is absorbed.

The mixture may also be produced as a sheet or as a paste to obtain a form which facilitates an actual use as the electromagnetic wave absorber.

The present invention also provides a method of manufacturing an electromagnetic wave absorber comprising the steps of: forming an organic material into a predetermined shape; and plating a magnetic material film on the surface of the organic material to form a magnetic material particle, such that the magnetic material particle is a shape approximately the same as the predetermined shape.

DETAILED DESCRIPTION OF THE PREFERRED EMBODIMENTS

Hereinafter, embodiments of the present invention will be described with reference to the drawings.

Figure 1:
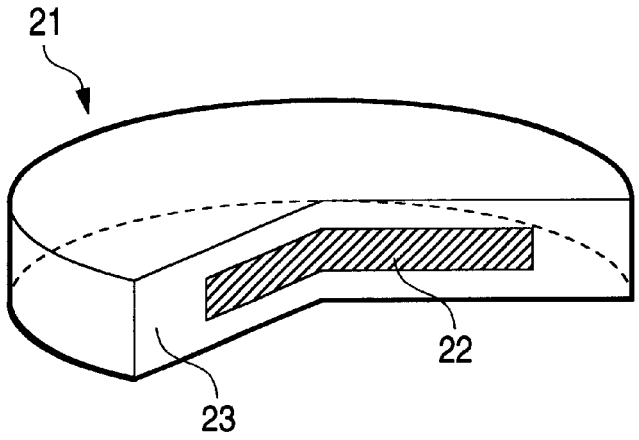
FIG. 1 is a partially cutaway schematic view of the magnetic material particle according to the present invention.

FIG. 1 is partially cutaway schematic view of a magnetic material particle according to the present invention.

As shown in the drawing, a magnetic material particle 21 includes a nucleus 22 made of organic material and a magnetic material film 23 made of soft metal magnetic material plating. Although the shape of the magnetic material particle 21 depends on the shape of the nucleus 22, the size is also changed by the thickness of the magnetic material film 23, and various composite magnetic materials can be obtained also by, for example, forming the magnetic material film 23 only on one side of the nucleus 22.

The soft metal magnetic material may be a ferromagnetic material including at least one ferromagnetic element such as Fe, Co and Ni. Alternatively a Heusler alloy, such as $Cu_2MnAl$ or MnAl, or the like may also be used. Furthermore, the soft metal magnetic material may also include a ferromagnetic material containing Dy or Gd as a rare earth element. In the present invention, any metal may be used as long as the ferromagnetic material is revealed, and the invention is not limited to the foregoing magnetic materials.

The organic material forming the nucleus 22, may be selected from various materials such as liquid crystal polymer, epoxy resin, phenolic resin, ABS resin, plastic material, or imide resin. However, the nucleus is not limited to the foregoing organic materials.

The shape of the nucleus 22 in one embodiment is a circular flat plate shape, since the resonance frequency depends on the shape of the soft magnetic material metal. However, the nucleus may be an elliptical shape, a needle shape, a rod shape, a pipe shape, a lens shape, a polygonal shape or another shape. Every shape is a method for controlling the resonance frequency, and limitation is not made to the foregoing shapes. In general, if anisotropy is provided in one direction like the needle shape, there is a tendency for the resonance frequency to increase. The resonance frequency indicates a frequency in which $\mu''$ (term of magnetic loss) as an imaginary part of permeability takes the maximum value, and the energy of an electromagnetic wave can be effectively absorbed at this frequency.

The magnetic material film 23 is formed around the nucleus 22 by using a thin film technique such as a dry process or electroless plating. For example, in the electroless plating, it is possible to control the film thickness by the plating condition. In the present invention, the thickness is preferably controlled to be a thickness of a skin depth or less at a high frequency. The skin depth is defined as follows.

$$\delta=(2\rho/\omega\mu)^{1/2}$$

Where, $\delta$: skin depth (m), $\rho$: resistivity ($\Omega$m), $\omega$: angular speed ($sec^{-}$)), $\mu$: permeability ($4\pi\times10^{-7}$ H/m).

As an example, when a Fe base material of $\mu=10$ is magnetized at 1 GHz, the resistivity is made $\rho=1\times10^{-7}$ $\Omega$m, and $\delta=1.6$ $\mu$m. Normally, in a case where the magnetic material is magnetized in the GHz band, the skin depth becomes a thickness of several $\mu$m or less.

In order to use the soft magnetic metal powder according to the present invention for the electromagnetic wave absorber, it is necessary to make a composite by using an organic binding material. In general, a metal simple substance completely reflects an electric wave and functions as a shielding material, not as an absorber. When it is combined with a suitable organic binding material, the dielectric constant becomes about 50 to 200, and an absorption effect can be exhibited while reflection of the electric wave is suppressed. As such, it becomes possible to form a high performance electromagnetic wave absorber.

Various types of organic binding materials are well-known and may be used. For example, polyester resin, polyvinylchloride resin, polyurethane resin, cellulosic resin, butadiene rubber, epoxy resin, phenole resin, amide resin, imide resin, or the like can be used. Since these organic binding materials are used for separating soft magnetic metals and as supporting materials, limitation is not made to the above resins.

The organic binding material and the metal soft magnetic material are mixed in the range in which the filling amount of the metal soft magnetic material is about 50 to 90 wt %, the mixture becomes a paste. In order to obtain a material for electric wave absorption by using the metal soft magnetic material of the present invention, it is necessary that the magnetic material and the organic material are substantially mixed, and the metal soft magnetic materials are separated from one another. This is because continuous, one reflector is made. The magnetic material powders of the present invention are supported in the state where they are separated from one another in the organic binding material. The filling amount is influenced by abrasion when a flat particle is mixed, and it is difficult to fill highly the flake-shaped flat particle having a number of protrusions. Moreover, since the flat particle having a rounded surface obtained in the present invention has low frictional resistance, it is highly filled relatively easily. Accordingly, absorption efficiency becomes high. Furthermore, because of the flat shape, the arrangement of particles by natural orientation becomes more apt to occur.

The mixed composite of the magnetic material particle and the organic binding material, may be formed into a paste. It is also conceivable to work the mixed composite into a sheet shape by a doctor blade method or the like. Alternatively, by using it as a mold of an IC or LSI, it may also be employed for a use of preventing EMI (Electromagnetic Interference).

Figure 2:
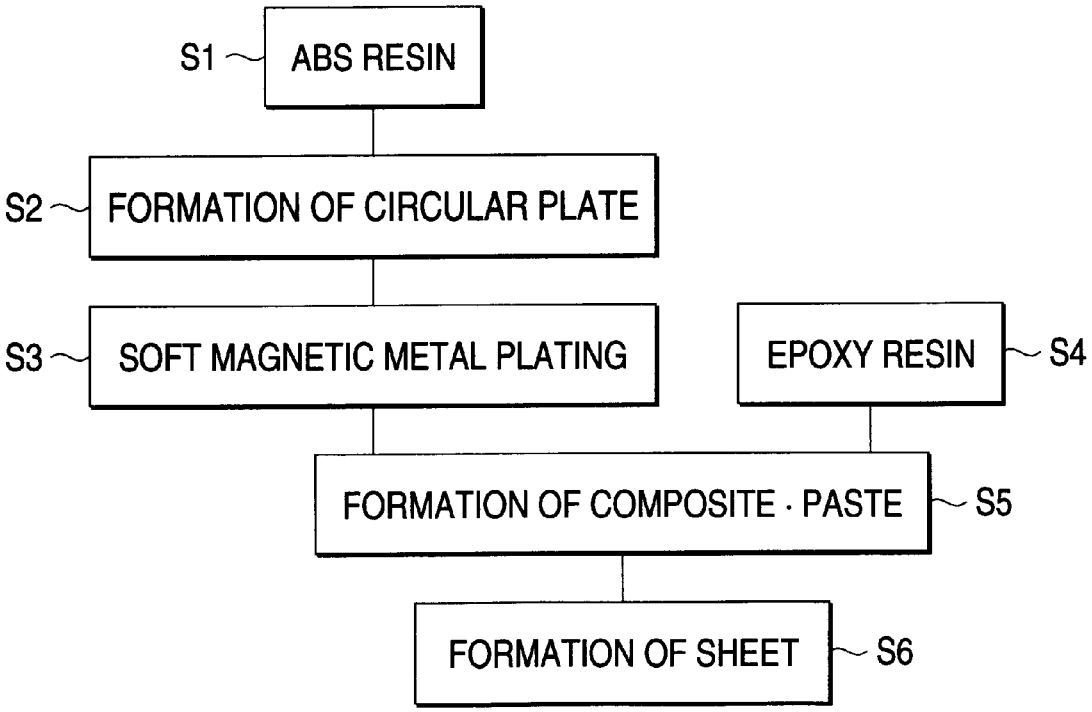
FIG. 2 is a flow diagram showing an example of a forming procedure of a metal soft magnetic material according to the present invention.

FIG. 2 is a flow diagram showing an example of a forming procedure of the metal soft magnetic material according to the present invention.

Since the metal soft magnetic material containing at least one kind of Fe, Co, Ni and the like has high saturated magnetization, high permeability can be expected. However, since it is metal, the melting point is as high as about 1500° C., and it is difficult to obtain a circular flat plate shape by improving a powder forming method such as atomizing. However, since the organic material has a low melting point and workability is excellent, it is easy to form a fine circular flat plate from the organic material. Thus, a soft magnetic material metal of a circular flat plate shape may be detained by using, as the nucleus, the organic material by which the circular flat plate shape can be relatively easily obtained and by forming the soft magnetic material metal around the nucleus by a thin film forming method.

First, an ABS resin is prepared (step S1). The resin is made into a disk-shape by, for example, an after-mentioned method shown in FIG. 3, forming a circular flat plate shape nucleus having, for example, a diameter of 40 $\mu$m and a thickness of 0.5 to 1 $\mu$m (step S2). A magnetic film is formed on the circular plate nucleus of the ABS resin by a plating treatment of soft magnetic metal (step S3), and the magnetic material particle 21 shown in FIG. 1 is formed.

On the other hand, an epoxy resin which becomes the organic binding material is prepared (step S4), the composite magnetic material (magnetic material 21) and the epoxy resin (step S4) are mixed to have a ratio of 80:20 in weight %, and a paste-shaped composite magnetic material is obtained (step S5). If necessary, a sheet-shaped composite magnetic material may also be obtained by a doctor blade method (step S6).

Figure 3:
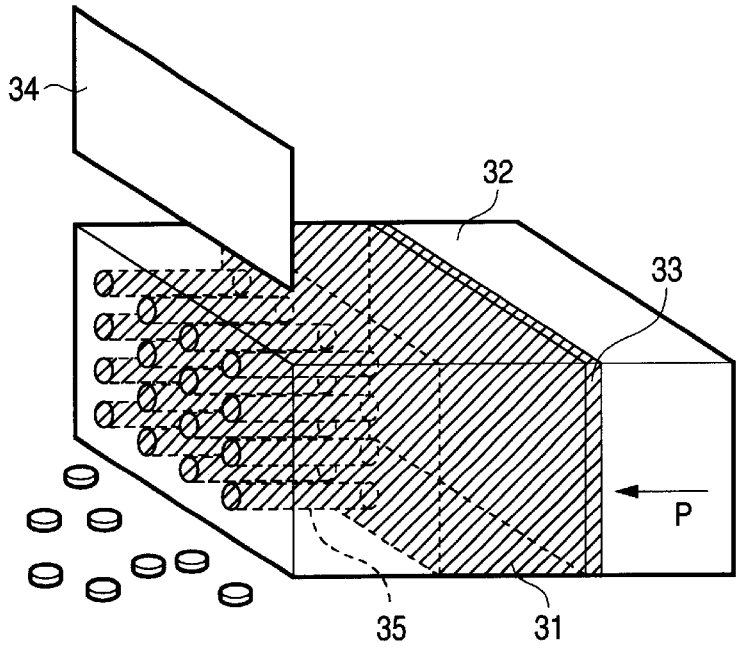
FIG. 3 is a schematic view showing a method of making an organic material into a disk-shape.

FIG. 3 is a schematic view showing one method of forming the organic material at step S2 into the shape of a disk.

As shown in the drawing, an organic material 31 may be filled in a container 32, the organic material 31 is pushed in a direction of arrow P, is successively pushed out through a cylinder 35 or a circular hole provided at a side opposite to a press surface 33, and is cut off by a blade 34 when it goes out of the side face of the container 32. In this way, the organic material is made into the shape of a disk. Other than this method, a method of formation by a metal mold, a method of formation using a microtome, a method of punching a thin film, or the like may also be used.

Figure 4:
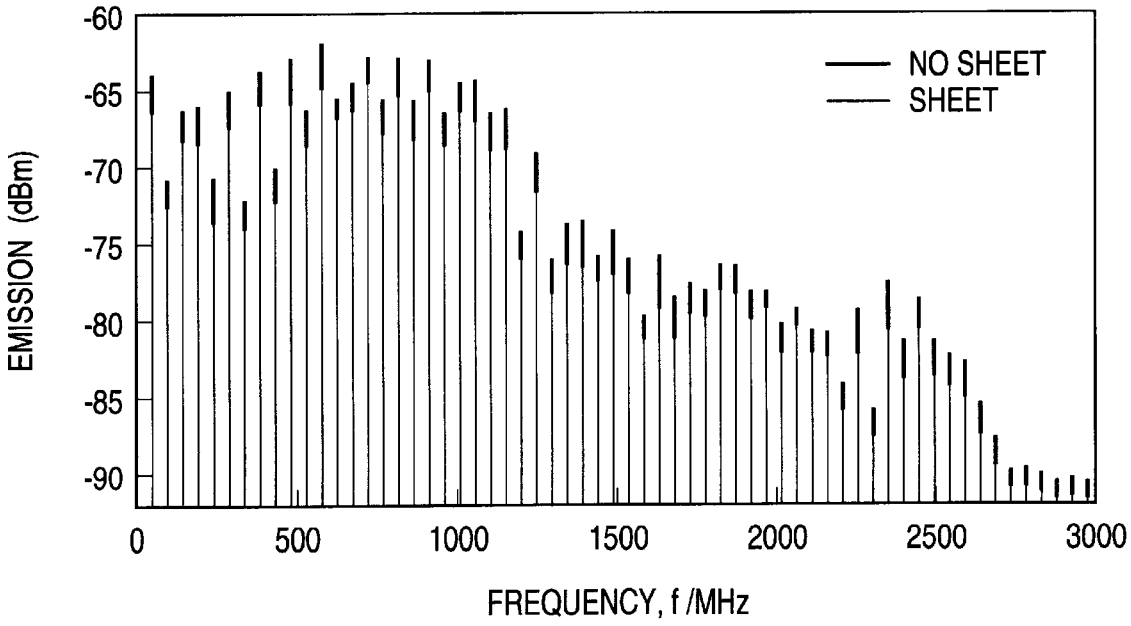
FIG. 4 is a graph showing a comparison of noise level between a case where a sheet-shaped composite magnetic material formed in FIG. 2 is stuck to an electronic instrument and a case where it is not stuck.
Figure 5:
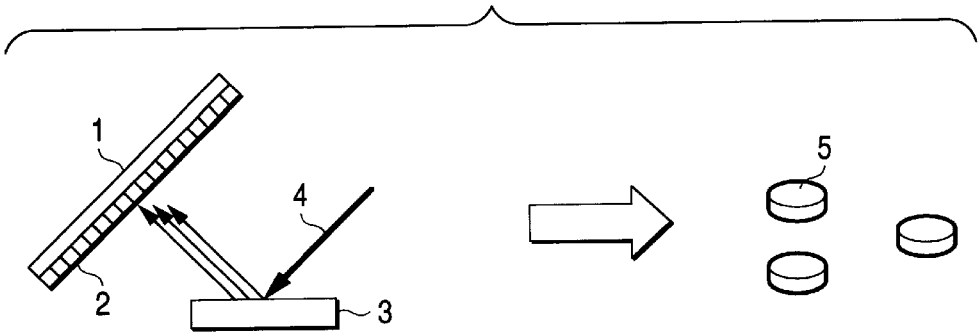
FIG. 5 is a schematic explanatory view showing a method of forming a disk-shaped magnetic material from a thin film.
Figure 6:
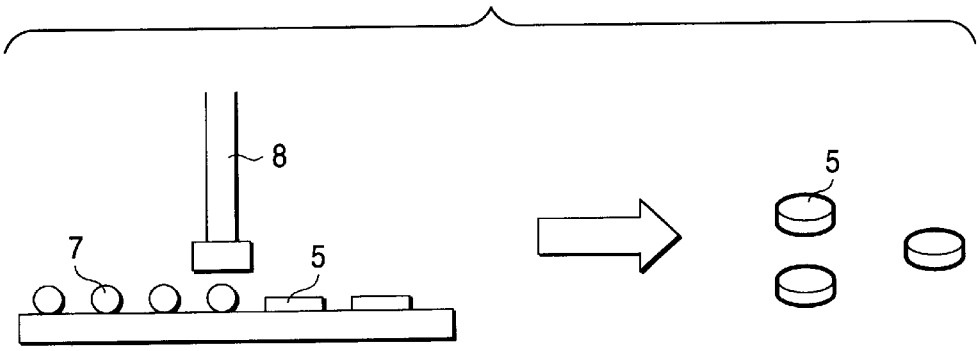
FIG. 6 is a schematic explanatory view showing a method of forming a disk-shaped magnetic material from a spherical powder particle.
Figure 7:
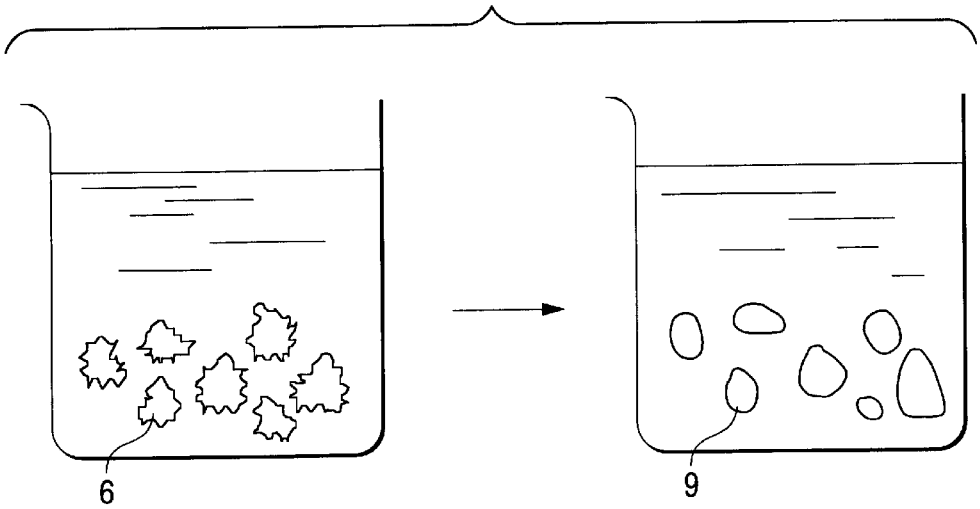
FIG. 7 is a schematic view showing a surface treatment by acid with respect to the powder magnetic material formed in FIG. 5 or FIG. 6.

FIG. 4 is a graph showing a comparison of noise level between a case where a sheet-shaped composite magnetic material formed in FIG. 2 is used in association with an electronic instrument and a case where the composite magnetic material is not used.

A thick line indicates a radiation level in the case where there is no sheet, and a thin line indicates a radiation level in the case where there is a sheet. As shown in the drawing, a sample of a sheet having a thickness of 100 $\mu$m and formed by the doctor blade method of FIG. 2 into a sheet (step S6) was stuck on an IC generating a noise having a frequency of 0 to 3 GHz, and a noise reduction effect before and after the sticking was measured. In the case where the sheet was used as the noise reduction effect of about 3 dB was observed, compared with the case where the was not stuck, and it was confirmed that the electric wave absorption effect was high although the sheet was thin.

As described above, in the present invention, the magnetic material particle is formed by a nucleus made of an organic material and a magnetic material film formed on its surface, so that the surface of the metal soft magnetic material is easily smoothed at low cost, and a regular shape, such as a disk or ellipse is obtained. As a result, the permeability of the electromagnetic wave absorber is increased, and the uniformity, reproducibility, and productivity of the magnetic material particle is raised. Also, since the surface of the magnetic material particle is smoothed, the resistance for mixture is low, the filling rate to the organic binding material is increased, and the permeability is also increased.

What is claimed is:

1. An electromagnetic wave absorber including a mixture comprising a magnetic material particle and a binding material, wherein the magnetic material particle includes a nucleus made of an organic material and a magnetic material film formed on a surface of the nucleus.

2. An electromagnetic wave absorber according to claim 1, wherein a film thickness of the magnetic material film is a skin depth or less.

3. An electromagnetic wave absorber according to claim 1 wherein the magnetic material particle has a shape determined by a predetermined shape of the nucleus.

4. An electromagnetic wave absorber according to claim 1 wherein the organic material comprises any one of a liquid crystal polymer, an epoxy resin, a phenol resin, an ABS resin, a plastic material, and an imide resin.

5. An electromagnetic wave absorber according to claim 1 wherein the magnetic material film includes a ferromagnetic material having at least one element selected from the group consisting of Fe, Co, and Ni.

6. An electromagnetic wave absorber according to claim 1 wherein the magnetic material film includes a Heusler alloy.

7. An electromagnetic wave absorber according to claim 1 wherein the magnetic material film includes a ferromagnetic material having at least one element selected from the group consisting of Dy and Gd.

8. An electromagnetic wave absorber according to claim 1 wherein the binding material is composed of any one of a polyester resin, polyvinylchloride resin, polyurethane resin, cellulosic resin, butadiene rubber, epoxy resin, phenol resin, amide resin, and imide resin.

9. An electromagnetic wave absorber according to claim 1 wherein the mixed material is produced as a paste.

10. An electromagnetic wave absorber according to claim 1 wherein the mixed material is produced as a sheet.

11. The absorber of claim 1 wherein the nucleus is within the magnetic material film.

12. A method of manufacturing an electromagnetic wave absorber comprising the steps of:

forming an organic material into a predetermined shape; and plating a magnetic material film on the surface of the organic material to form a magnetic material particle, such that the magnetic material particle is a shape approximately the same as the predetermined shape.

13. A method according to claim 12 further including forming a mixture comprising a binding material and at least one magnetic material particle.

* * * * *